US007735519B2

(12) United States Patent
Lin

(10) Patent No.: US 7,735,519 B2
(45) Date of Patent: Jun. 15, 2010

(54) WATER INLET DEVICE FOR MOUNTING A VALVE BODY ON A DECK BACKGROUND OF THE INVENTION

(76) Inventor: Ming-Shuan Lin, No. 29-2, Sec. 1, Tafeng Rd., Tantzu Hsiang, Taichung Hsien (TW)

( * ) Notice: Subject to any disclaimer, the term of this patent is extended or adjusted under 35 U.S.C. 154(b) by 605 days.

(21) Appl. No.: 11/805,442

(22) Filed: May 23, 2007

(65) Prior Publication Data

US 2008/0289698 A1 Nov. 27, 2008

(51) Int. Cl.
*F16K 11/02* (2006.01)

(52) U.S. Cl. ..... 137/801; 137/315.12; 4/695

(58) Field of Classification Search ..... 137/315.12, 137/625.4, 625.17, 801; 4/677, 695; 285/64
See application file for complete search history.

(56) References Cited

U.S. PATENT DOCUMENTS 5,224,509 A * 7/1993 Tanaka et al. ..... 137/315.03
5,558,128 A * 9/1996 Pawelzik et al. ..... 137/801
6,006,784 A * 12/1999 Tsutsui et al. ..... 137/801
6,073,972 A * 6/2000 Rivera ..... 285/64
6,286,808 B1 * 9/2001 Slothower et al. ..... 251/118
6,328,059 B1 * 12/2001 Testori et al. ..... 137/315.12
6,807,692 B2 * 10/2004 Tsutsui et al. ..... 4/695
6,912,742 B1 * 7/2005 Wang ..... 4/695
7,032,260 B2 * 4/2006 Hwang ..... 4/695
2005/0077725 A1 * 4/2005 Bartholoma et al. ..... 285/143.1

* cited by examiner

*Primary Examiner*—John Fox
(74) *Attorney, Agent, or Firm*—Ladas & Parry, LLP

(57) ABSTRACT

A water inlet device is adapted for mounting a valve body that is formed with a water inlet hole on top of a deck. The water inlet device includes a fixing unit adapted to be secured to the deck and formed with a water supply hole, a connecting unit, and a switch unit. The connecting unit includes a connecting component adapted to be secured to the valve body, and a coupling unit that permits rotation of the connecting component relative to the fixing unit between a first position, where the connecting component is separable from the fixing unit, and a second position, where the connecting component is non-separable. The switch unit is retained rotatably on the fixing unit, is coupled co-rotatably and separably to the connecting component, and blocks the water supply hole when the connecting component is at the first position.

8 Claims, 9 Drawing Sheets

WATER INLET DEVICE FOR MOUNTING A VALVE BODY ON A DECK BACKGROUND OF THE INVENTION

BACKGROUND OF THE INVENTION

1. Field of the Invention

The invention relates to a tapware, more particularly to a water inlet device for mounting a valve body on a deck.

2. Description of the Related Art

As shown in FIG. 1, a faucet 2 is to be mounted to a deck 1 and includes a valve body 3 that is connected to a water inlet pipe 4. The valve body 3 is formed with a water inlet hole 301 and a screw hole 302. The faucet 2 further includes a threaded securing component 303 and a nut 304. The threaded securing component 303 has one end that engages threadedly the screw hole 302, and an opposite end extending through the deck 1 and engaging the nut 304 so as to secure the faucet 2 to the deck 1. The water inlet pipe 4 has one end fixed in the water inlet hole 301, and an opposite end connected to a control valve 5.

When the faucet 2 is broken and needs to be replaced, a repairman has to close the control valve 5, disconnect the water inlet pipe 4 from the water inlet hole 301 in the valve body 3, loosen the nut 304, and then disconnect the threaded securing component 303 from the screw hole 302. The faucet dismounting operation is performed in a reversed order when installing a new faucet 2 on the deck 1. Therefore, the replacement process is relatively complicated. Moreover, during the process of replacing or installing the faucet 2, the repairman has to operate under the deck 1, which is inconvenient and incurs high labor costs.

SUMMARY OF THE INVENTION

Therefore, the object of the present invention is to provide a water inlet device for mounting a valve body on a deck, which facilities installation and replacement to result in lower labor costs, and which is able to prevent water from spouting out during replacement.

Accordingly, a water inlet device of the present invention is adapted for mounting a valve body that is formed with a water inlet hole on top of a deck that has a top surface, and is adapted to be connected to a water inlet pipe. The water inlet device comprises a fixing unit, a connecting unit, and a switch unit. The fixing unit is adapted to be secured to the top surface of the deck, and is formed with a water supply hole corresponding in position to the water inlet hole in the valve body and adapted for connection to the water inlet pipe. The connecting unit is adapted to couple separably the valve body to the fixing unit, and includes a connecting component and a coupling unit. The connecting component is adapted to be secured to the valve body, and is formed with a guide hole to fluidly communicate the water inlet hole in the valve body and the water supply hole in the fixing unit. The coupling unit is for coupling rotatably the connecting component to the fixing unit, and includes a first coupling component provided at the fixing unit and a second coupling component provided at the connecting component. The second coupling component cooperates with the first coupling component to permit rotation of the connecting component relative to the fixing unit between a first position, where separation of the connecting component from the fixing unit in a vertical direction is permitted, and a second position, where separation of the connecting component from the fixing unit in the vertical direction is prevented. The switch unit is retained rotatably on the fixing unit, is coupled co-rotatably and separably to the connecting component of the connecting unit, and is formed with a guide channel. The guide channel fluidly communicates the guide hole in the connecting component and the water supply hole in the fixing unit when the connecting component is at the second position. The guide channel is misaligned with the water supply hole, and the switch unit blocks the water supply hole, when the connecting component is at the first position.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
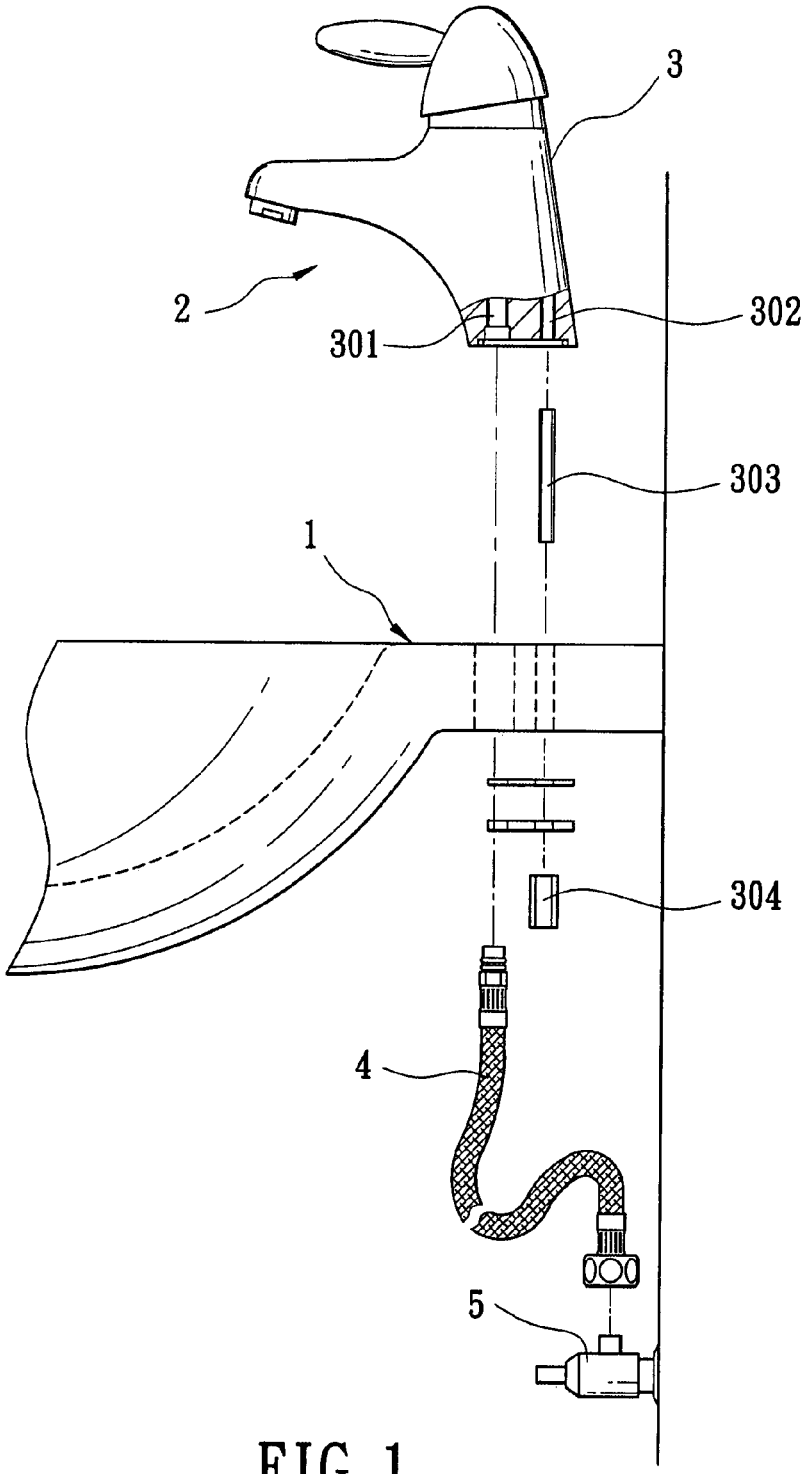
FIG. 1 PRIOR ART
FIG. 1 is an exploded schematic view to illustrate how a faucet is mounted on a deck in the prior art.
Figure 2:
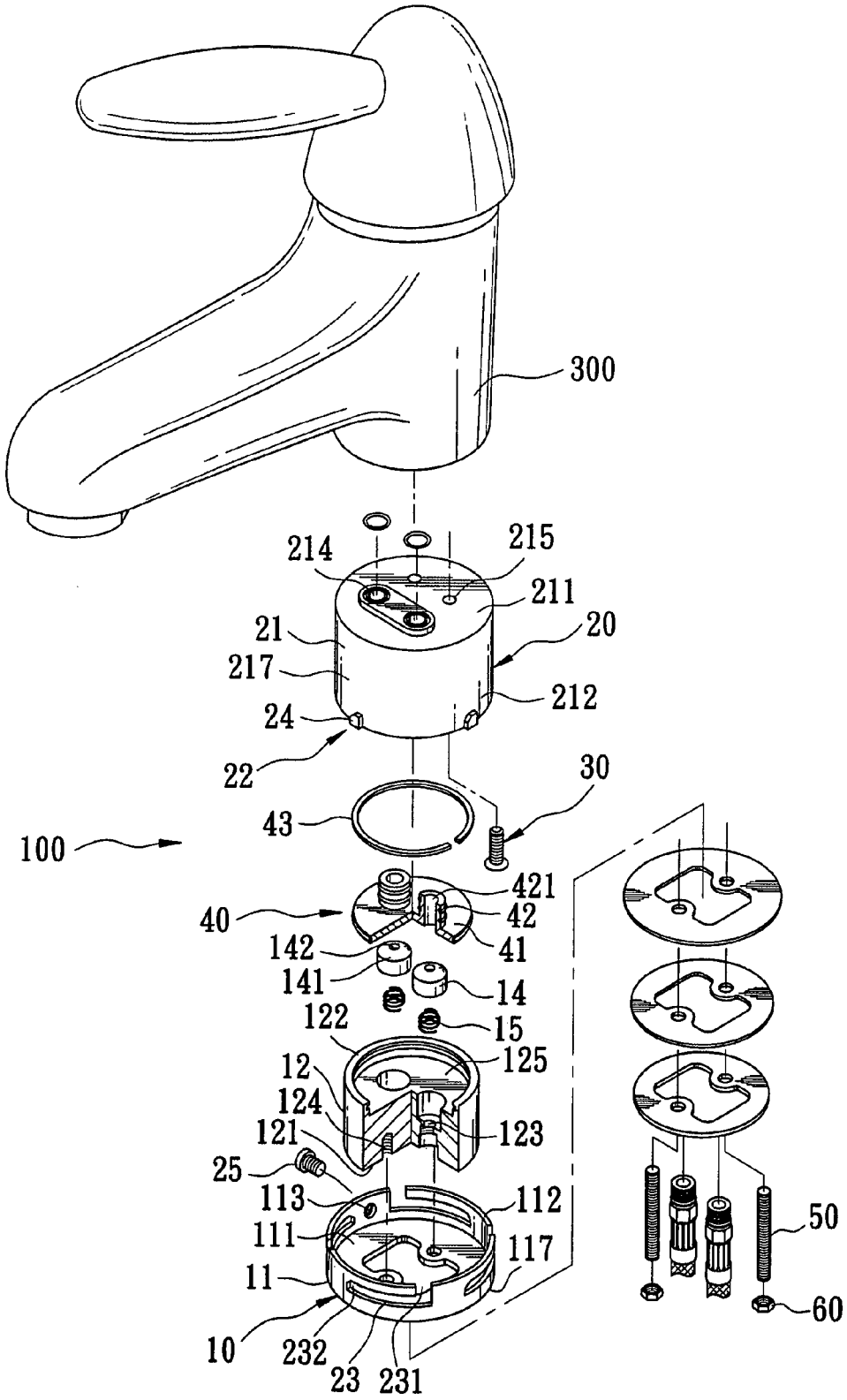
FIG. 2 is an exploded partly sectional perspective view of a preferred embodiment of a water inlet device according to the invention.
Figure 3:
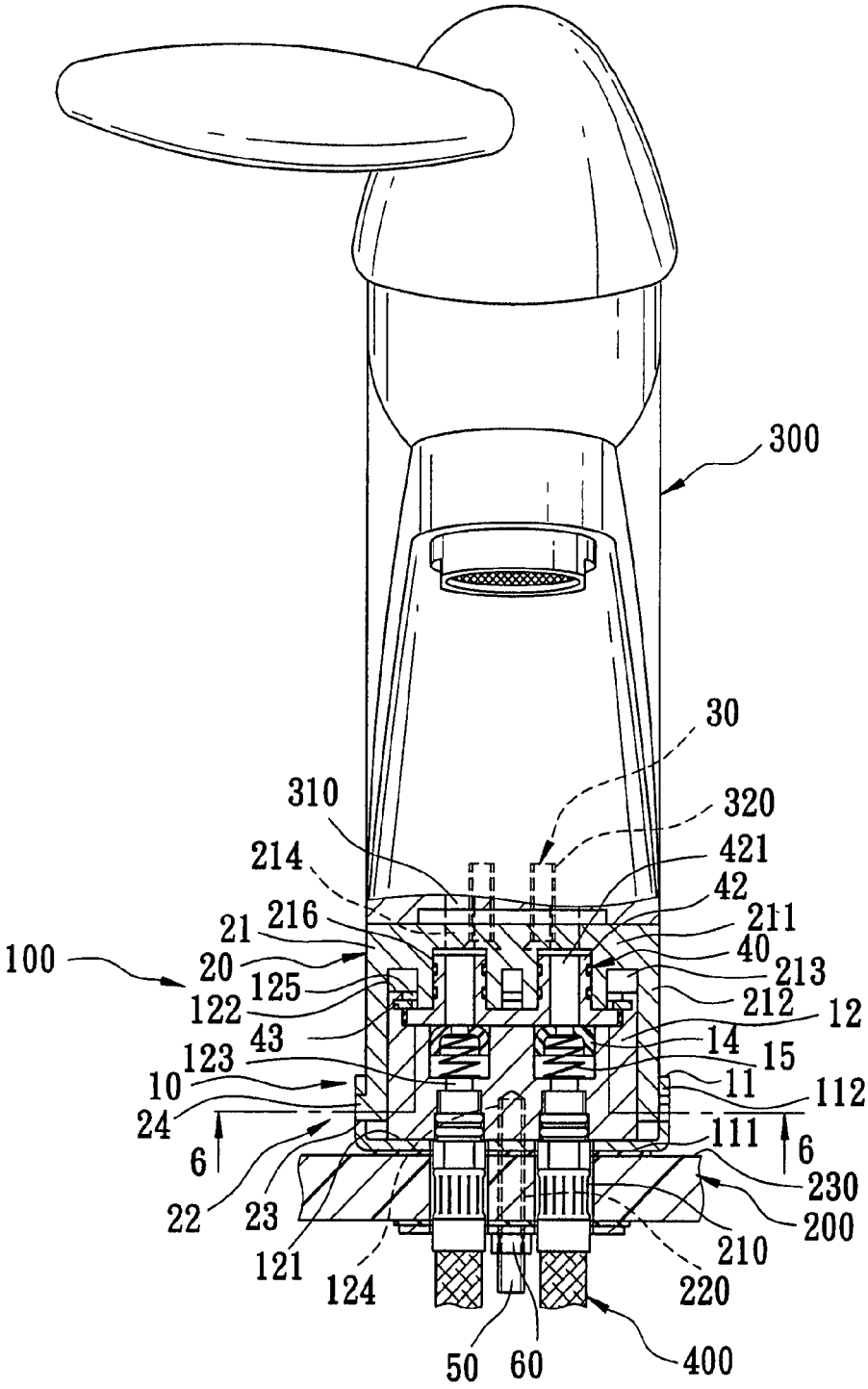
FIG. 3 is an assembled sectional view of the preferred embodiment.

As shown in FIGS. 2 and 3, the preferred embodiment of a water inlet device 100 according to the present invention is adapted for mounting a valve body 300 on top of a deck 200 that has a top surface 230, and is adapted to be connected to a pair of water inlet pipes 400. The deck 200 has a pair of pipe holes 210 and a pair of through holes 220 (only one is shown). The valve body 300 is formed with a pair of water inlet holes 310 that correspond in position to the pipe holes 210 in the deck 200, and a pair of screw holes 320. The water inlet pipes 400 are connected to a control valve (not shown) in a conventional manner. The water inlet device 100 comprises a fixing unit 10, a connecting unit 20, a pair of screws 30, a switch unit 40, a pair of threaded securing components 50, and a pair of nuts 60.

The fixing unit 10 includes a fixing plate component 11 adapted to be secured to the top surface 230 of the deck 200, and a water guide seat 12 disposed on the fixing plate component 11. The fixing plate component 11 includes a base plate 111 having a plate periphery 117, and a side wall 112 extending upwardly from the plate periphery 117 and formed with a positioning screw hole 113. The water guide seat 12 has a bottom seat surface 121 that abuts against the base plate 111, a top seat surface 122 that is opposite to the bottom seat surface 121, a pair of water supply holes 123 that extend from the bottom seat surface 121 to the top seat surface 122, that correspond respectively in position to the water inlet holes 310 in the valve body 300, and that are adapted to be connected respectively to the water inlet pipes 400, a pair of threaded holes 124 that are formed in the bottom seat surface 122, and a recess portion 125 that is formed in the top seat surface 122. The fixing unit 10 further includes a pair of positioning caps 14, each of which is movably disposed in a respective one of the water supply holes 123 and has a top end 141 formed with an aperture 142, and a pair of elastic components 15 disposed respectively in the water supply holes 123.

Figure 9:
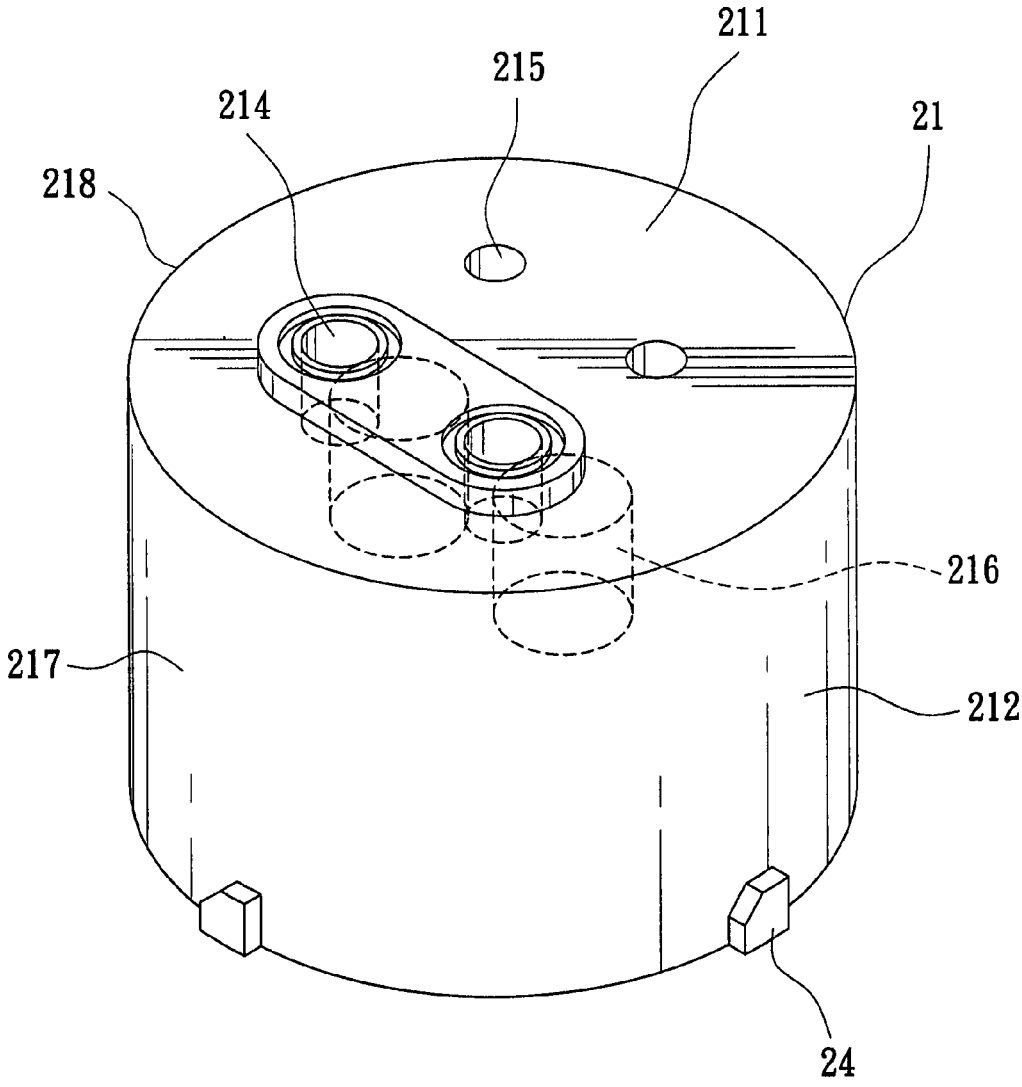
FIG. 9 is a perspective view of the connecting component.

The connecting unit 20 includes a connecting component 21 adapted to be secured to the valve body 300 through the screws 30, and a coupling unit 22 for coupling rotatably the connecting component 21 to the fixing unit 10. As further shown in FIG. 9, the connecting component 21 includes a top wall 211 and a surrounding wall 212. The top wall 211 is formed with a pair of guide holes 214 to fluidly and respectively communicate the water inlet holes 310 in the valve body 300 and the water supply holes 123 in the fixing unit 10, and a pair of locking holes 215 corresponding in position to the screw holes 320 in the valve body 300 and through which the screws 30 extend respectively, and has a wall periphery 218 and a bottom side formed with a pair of insert holes 216 that are in spatial communication with the guide holes 214, respectively. The surrounding wall 212 extends downwardly from the wall periphery 218, has an outer surrounding surface 217, and cooperates with the top wall 211 to define a receiving hole 213 to permit sleeving of the connecting component 21 on the water guide seat 12. In this embodiment, the coupling unit 22 includes a plurality of first coupling components 23 provided at the side wall 112 of the fixing plate component 11, and a plurality of second coupling components 24 provided at the surrounding wall 212. Each of the first coupling components 23 is in a form of a slot having a circumferentially extending segment 232, and a vertically extending segment 231 extending from one end of the circumferentially extending segment 232 to a top edge of the side wall 112. Each of the second coupling components 24 is in a form of a protrusion protruding outwardly from the outer surrounding surface 217 of the surrounding wall 212. The coupling unit 22 further includes a positioning screw 25 extending threadedly through the positioning screw hole 113 in the side wall 112, and pressing against the surrounding wall 212.

The switch unit 40 is retained rotatably on the fixing unit 10, is coupled co-rotatably and separably to the connecting component 21, and includes a circular blocking plate 41, a pair of protruding tubes 42, and a snap ring 43. The blocking plate 41 is disposed in the recess portion 125 of the water guide seat 12. The protruding tubes 42 protrude upwardly from the blocking plate 41, and extend respectively into the insert holes 216 in the top wall 211 of the connecting component 21. A pair of guide channels 421 are formed through the protruding tubes 42 and the blocking plate 41. The snap ring 43 retains rotatably the blocking plate 41 on the water guide seat 12. The elastic components 15 bias the positioning caps 14 to abut against the blocking plate 41.

The threaded securing components 50 are adapted to extend respectively through the through holes 220 in the deck 200, extend through the fixing plate component 11, and engage threadedly and respectively the threaded holes 124 in the water guide seat 12. The nuts 60 engage respectively the threaded securing components 50 and cooperate with the water guide seat 12 so as to be adapted to clamp the fixing plate component 11 and the deck 200 therebetween.

Figure 5:
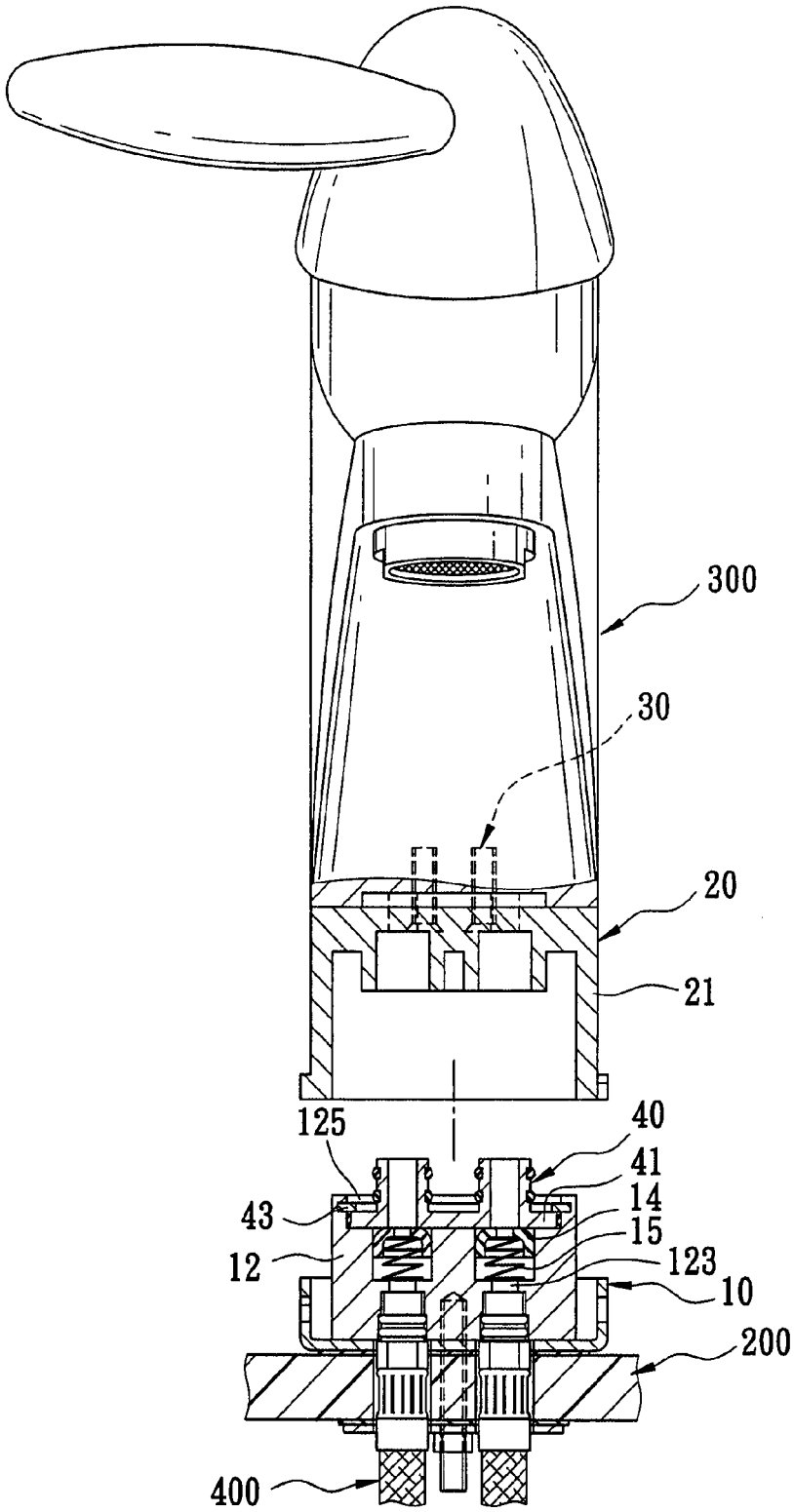
FIG. 5 is a partly exploded sectional view of the preferred embodiment, illustrating a connecting unit separated from a fixing unit.

As shown in FIG. 5, installation of the water inlet device 100 of the present invention involves a two-part process. First, the repairman mounts the fixing unit 10 retaining the switch unit 40 on top of the deck 200, and connects respectively the water inlet pipes 400 to the water supply holes 123 of the fixing unit 10. The second part of the process is to secure the connecting component 21 of the connecting unit 20 to the valve body 300 through the screws 30. This part of the process will be repeated whenever the valve body 300 is to be replaced.

Figure 4:
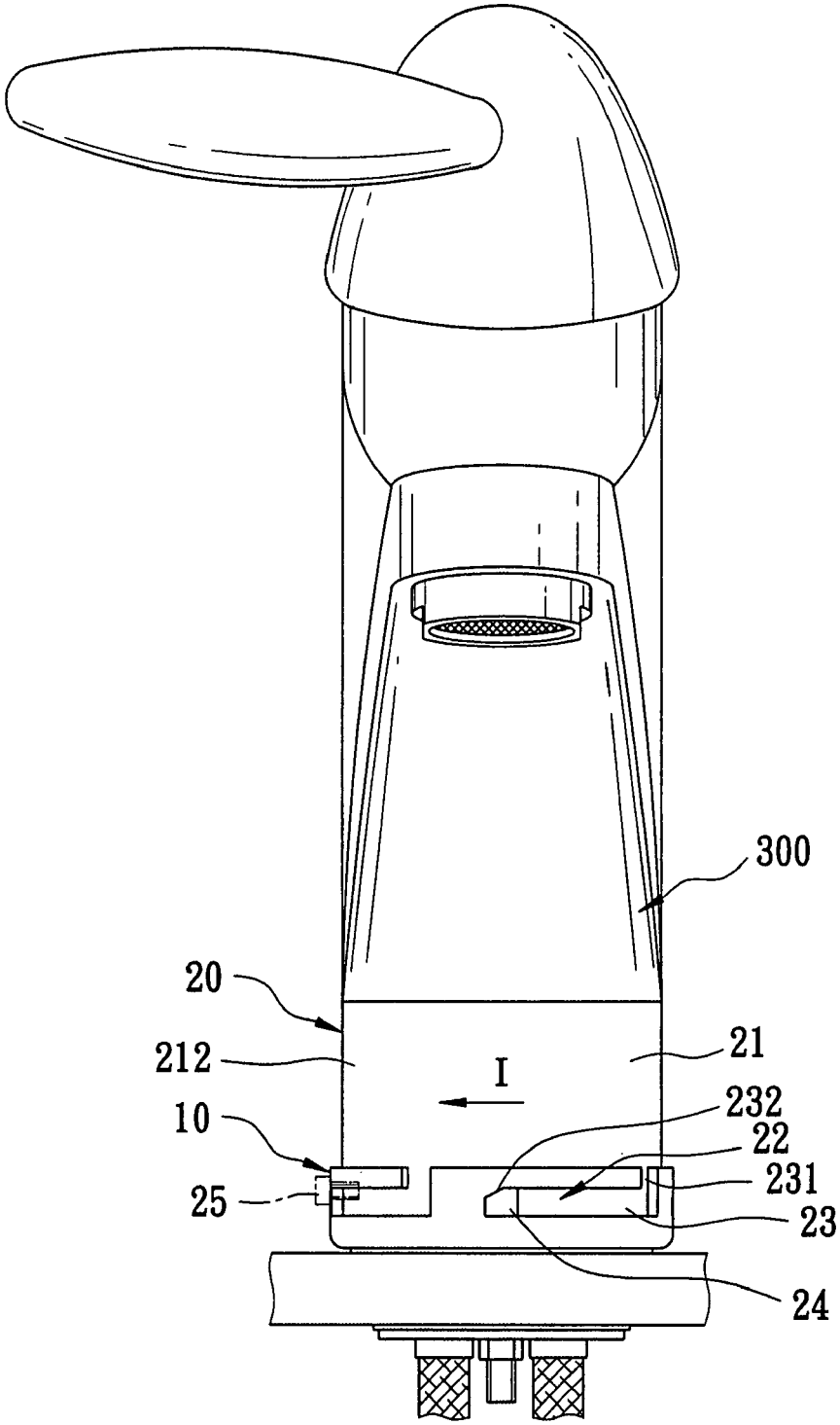
FIG. 4 is an assembled schematic front view of the preferred embodiment.
Figure 6:
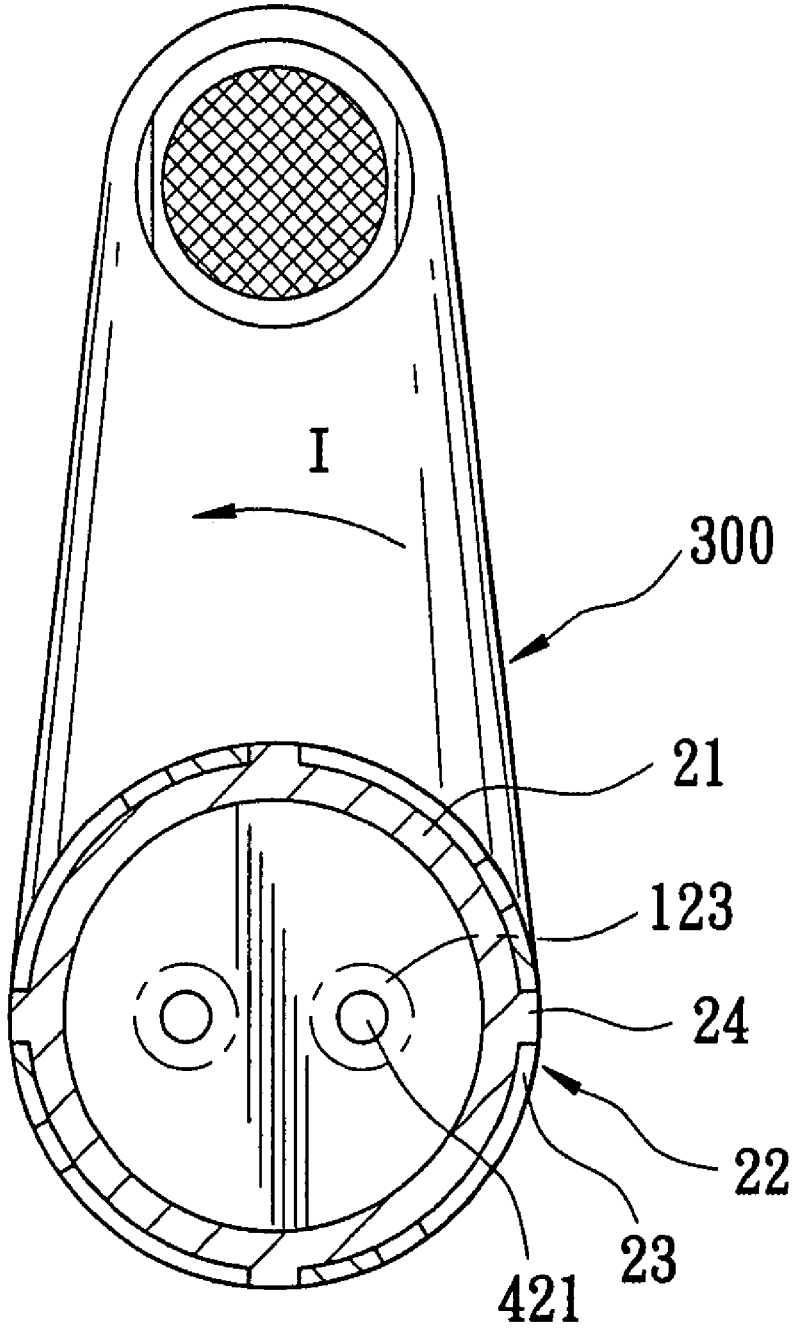
FIG. 6 is a sectional schematic bottom view of the preferred embodiment taken along line 6-6 in FIG. 3, illustrating a connecting component at a second position.
Figure 8:
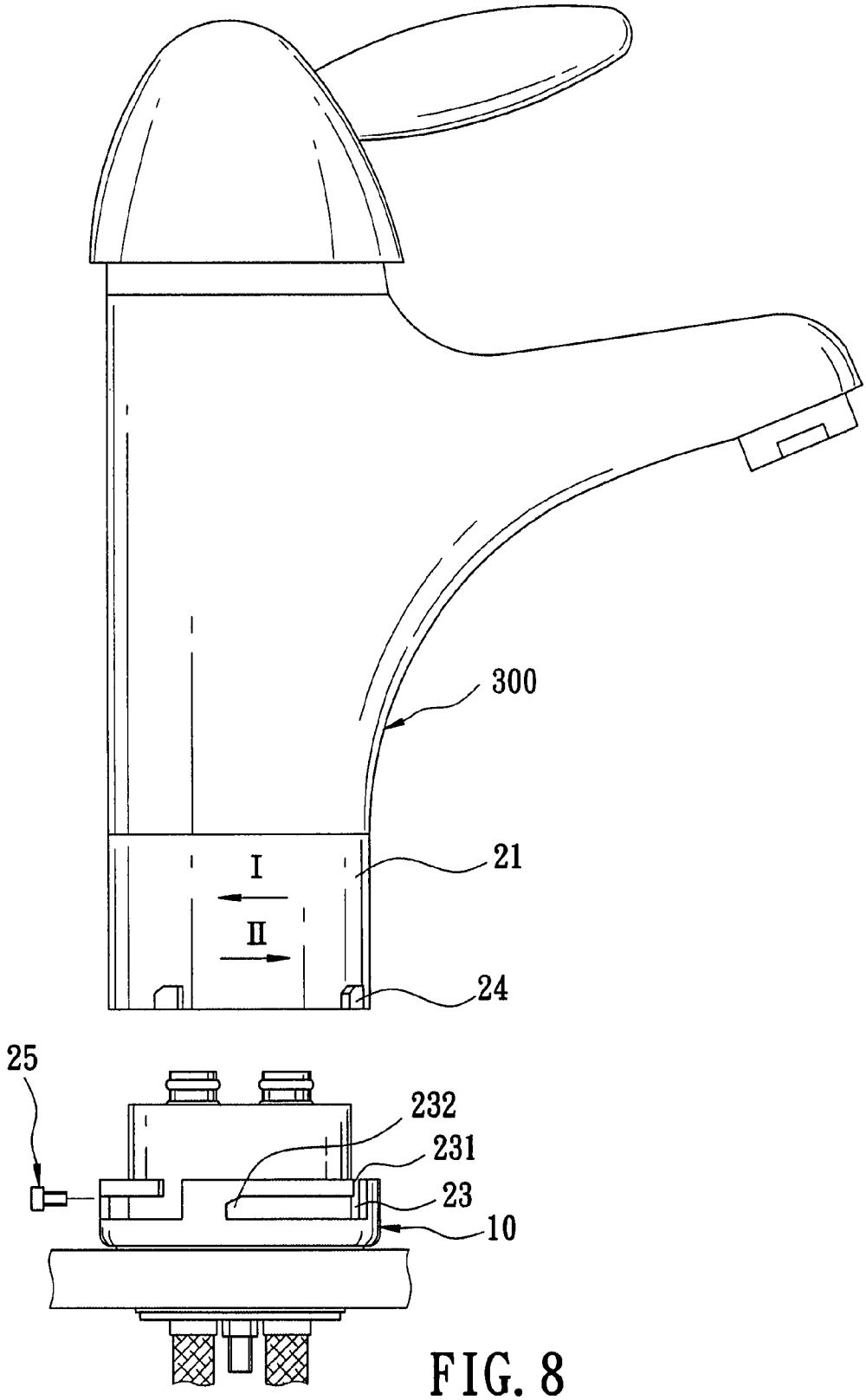
FIG. 8 is a partly exploded side view of the preferred embodiment.

As shown in FIGS. 4 and 8, to complete installation of the water inlet device 100 of the present invention, the repairman first registers each of the second coupling components 24 with the vertically extending segment 231 of a respective one of the first coupling components 23 and couples the valve body 300 together with the connecting component 21 to the fixing unit 10 at a first position, where each second coupling component 24 is extendible into and removable from the respective first coupling component 23 via the vertically extending segment 231, and where separation of the connecting component 21 from the fixing unit 10 in the vertical direction is permitted. Then, the repairman rotates the valve body 300 together with the connecting component 21 along a first direction (I) to a second position, where each of the second coupling components 24 is retained in the circumferentially extending segment 232 of the respective one of the first coupling components 23, and where separation of the connecting component 21 from the fixing unit 10 in the vertical direction is prevented. Finally, the repairman drives threadedly the positioning screw 25 to extend through the positioning screw hole 113 and press against the surrounding wall 212, so that the valve body 300 is secured to the fixing unit 10. As further shown in FIGS. 3 and 6, when the connecting component 21 is at the second position, the guide channels 421 fluidly and respectively communicate the guide holes 214 and the water supply holes 123.

Figure 7:
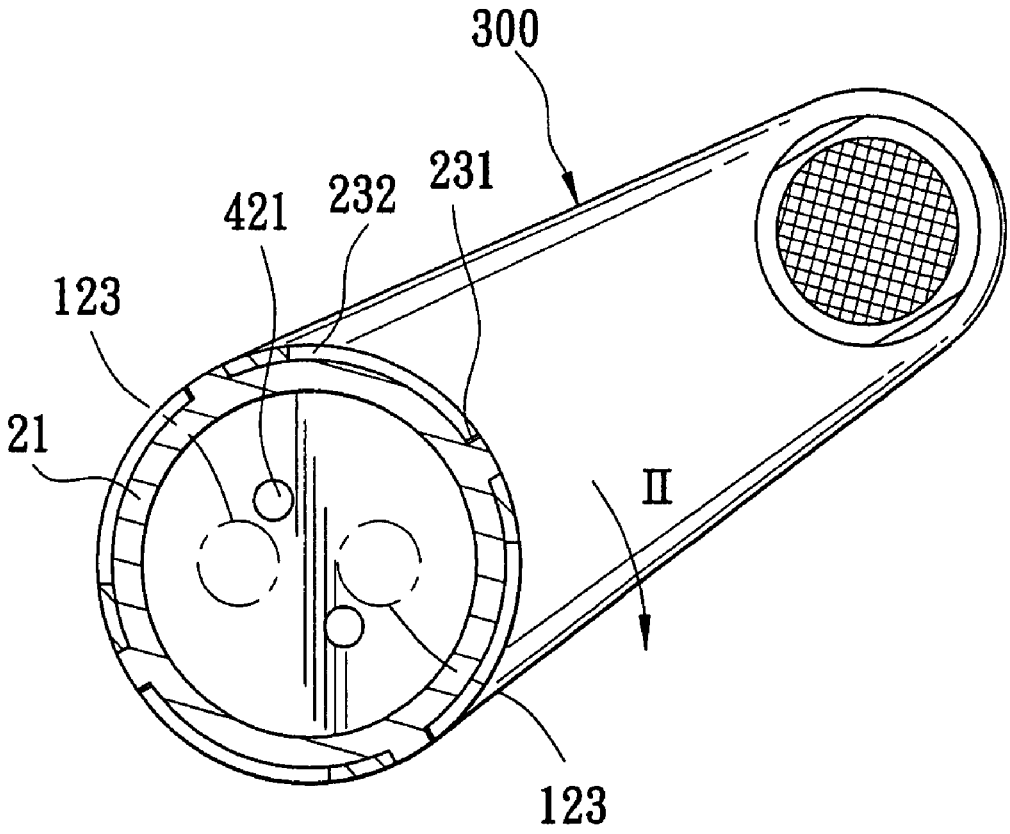
FIG. 7 is a view similar to FIG. 6, but illustrating the connecting component at a first position.

As shown in FIGS. 7 and 8, to replace the valve body 300, the repairman only needs to loosen the positioning screw 25, and rotate the valve body 300 together with the connecting component 21 in a second direction (II) back to the first position. Finally, the repairman pulls the valve body 300 together with the connecting component 21 away from the fixing unit 10. As further shown in FIGS. 3 and 7, when the connecting component 21 is at the first position, the guide channels 421 are misaligned with the water supply holes 123, and the blocking plate 41 blocks the water supply holes 123, thereby preventing water from spouting out during replacement.

Therefore, the process of installing and replacing is made simple by the water inlet device 100 of the present invention. Moreover, once the fixing unit 10 is secured to the deck 200, the repairman no longer has to work under the deck 200 to install or replace the valve body 300, thereby resulting in convenience and lower labor costs.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A water inlet device adapted for mounting a valve body on top of a deck, the valve body being formed with a water inlet hole, the deck having a top surface, said water inlet device being adapted to be connected to a water inlet pipe, said water inlet device comprising:

a fixing unit that is adapted to be secured to the top surface of the deck, and that is formed with a water supply hole corresponding in position to the water inlet hole in the valve body and adapted for connection to the water inlet pipe;

a connecting unit that is adapted to couple separably the valve body to said fixing unit, and that includes a connecting component adapted to be secured to the valve body, formed with a guide hole to fluidly communicate the water inlet hole in the valve body and said water supply hole in said fixing unit, and a coupling unit for coupling rotatably said connecting component to said fixing unit, said coupling unit including a first coupling component provided at said fixing unit and a second coupling component provided at said connecting component, said second coupling component cooperating with said first coupling component to permit rotation of said connecting component relative to said fixing unit between a first position, where separation of said connecting component from said fixing unit in a vertical direction is permitted, and a second position, where separation of said connecting component from said fixing unit in the vertical direction is prevented; and a switch unit that is retained rotatably on said fixing unit, that is coupled co-rotatably and separably to said connecting component of said connecting unit, and that is formed with a guide channel, said guide channel fluidly communicating said guide hole in said connecting component and said water supply hole in said fixing unit when said connecting component is at the second position, said guide channel being misaligned with said water supply hole and said switch unit blocking said water supply hole when said connecting component is at the first position.

2. The water inlet device as claimed in claim 1, wherein said fixing unit includes a fixing plate component adapted to be secured to the top surface of the deck, and a water guide seat disposed on said fixing plate component and formed with said water supply hole.

3. The water inlet device as claimed in claim 2, further comprising:

a threaded securing component adapted to extend through the deck and said fixing plate component of said fixing unit, and engaging threadedly said water guide seat of said fixing unit; and a nut engaging said threaded securing component and cooperating with said water guide seat so as to be adapted to clamp said fixing plate component and the deck therebetween.

4. The water inlet device as claimed in claim 2, wherein:

said fixing plate component of said fixing unit includes a base plate adapted to be disposed on the deck and having a plate periphery, and a side wall extending upwardly from said plate periphery of said base plate and provided with said first coupling component; and said connecting component of said connecting unit includes a top wall formed with said guide hole and having a wall periphery, and a surrounding wall extending downwardly from said wall periphery of said top wall and provided with said second coupling component.

5. The water inlet device as claimed in claim 4, wherein:

said first coupling component is in a form of a slot having a circumferentially extending segment, and a vertically extending segment extending from one end of said circumferentially extending segment to a top edge of said side wall; and said second coupling component is in a form of a protrusion that is extendible into and removable from said first coupling component via said vertically extending segment when said connecting component is at the first position.

6. The water inlet device as claimed in claim 4, wherein said connecting unit further includes a positioning screw extending threadedly through said side wall of said fixing plate component of said fixing unit, and pressing against said surrounding wall of said connecting component of said connecting unit.

7. The water inlet device as claimed in claim 4, wherein:

said top wall of said connecting component of said connecting unit has a bottom side formed with an insert hole in spatial communication with said guide hole; and said switch unit includes a circular blocking plate disposed between said water guide seat of said fixing unit and said top wall of said connecting component of said connecting unit, a protruding tube protruding upwardly from said blocking plate and extending into said insert hole in said top wall, and a snap ring for retaining rotatably said blocking plate on said water guide seat, said guide channel being formed through said protruding tube and said blocking plate.

8. The water inlet device as claimed in claim 7, wherein said fixing unit further includes a positioning cap movably disposed in said water supply hole in said water guide seat and having a top end formed with an aperture, and an elastic component disposed in said water supply hole for biasing said positioning cap to abut against said blocking plate of said switch unit, said water supply hole being communicated with said guide channel via said aperture in said positioning cap when said connecting component is at the second position.

* * * * *